US006502732B1

(12) United States Patent
Bonds

(10) Patent No.: US 6,502,732 B1
(45) Date of Patent: Jan. 7, 2003

(54) FOLDABLE SKI CARRIER PACK ASSEMBLY

(76) Inventor: Timothy R. Bonds, 3101 Francis St., Anniston, AL (US) 36201

( * ) Notice: Subject to any disclaimer, the term of this patent is extended or adjusted under 35 U.S.C. 154(b) by 0 days.

(21) Appl. No.: 09/431,079

(22) Filed: Nov. 1, 1999

(51) Int. Cl.[7] ..... A45C 7/00

(52) U.S. Cl. ..... 224/586; 229/201; 229/628; 229/634; 229/917

(58) Field of Search ..... 224/586, 201, 224/628, 629, 634, 917, 153, 250

(56) References Cited

U.S. PATENT DOCUMENTS

| | | | | | |
|---|---|---|---|---|---|
| 1,296,619 | A | * | 3/1919 | Bulat | 224/160 |
| 3,504,405 | A | * | 4/1970 | Elliott-Smith | 224/917 X |
| 4,308,982 | A | * | 1/1982 | Hall | 224/917 X |
| 4,790,460 | A | * | 12/1988 | Harper, Jr. | 224/250 |
| 5,803,332 | A | * | 9/1998 | Thompson | 224/917 X |

* cited by examiner

*Primary Examiner*—Gregory M. Vidovich
*Assistant Examiner*—Maerena W. Brevard
(74) *Attorney, Agent, or Firm*—Phillip A. Rein

(57) ABSTRACT

A foldable ski carrier pack assembly having 1) a main ski support frame assembly; 2) ski anchor assemblies secured to the main ski support frame assembly and operable to anchor snow skis thereto; and 3) a back support harness assembly connected to the main ski support frame assembly and operable to be placed about shoulder areas of a snow ski person for conveyance similar to a camper's backpack assembly. The main ski support frame assembly includes a first support frame member pivotally connected to a second support frame member by a main connector member. The first support frame member and the second support frame member each have a means thereon to receive the ski anchor assemblies connected thereto. Each ski anchor assembly includes a stabilizing post member having a retaining clamp assembly releasably connected thereto. Each retaining clamp assembly includes a main clamp assembly engageable about a portion of the snow skis and having an actuator handle assembly connected thereto. Each actuator handle assembly includes a knob member connected to an actuator shaft member and having a bias member thereon. The actuator shaft member is engageable with the clamp body member through a clamp receiving slot assembly in the stabilizing post member so as to hold in a locked bias condition where the snow skis are clamped against the main ski support frame assembly. The back support harness assembly is of a conventional nature having a pair of spaced harness strap assemblies, each having first and second strap members therein connected to each other by a buckle member for clamping against the shoulder area of the snow ski person.

11 Claims, 3 Drawing Sheets

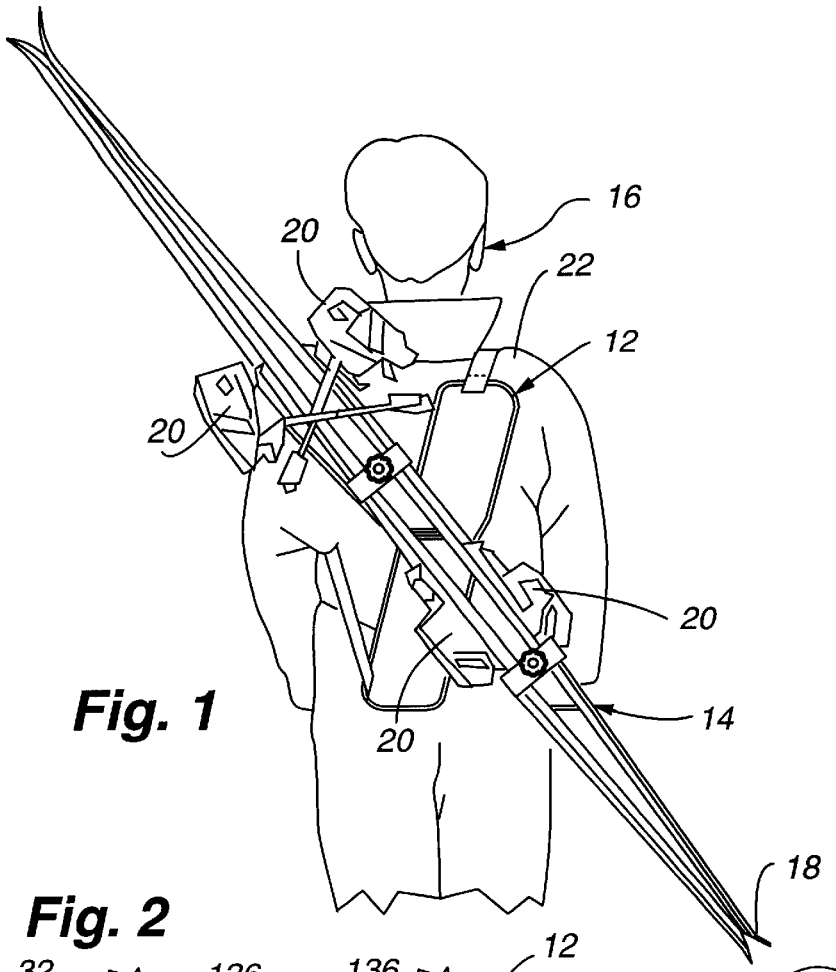
Fig. 1
Fig. 2
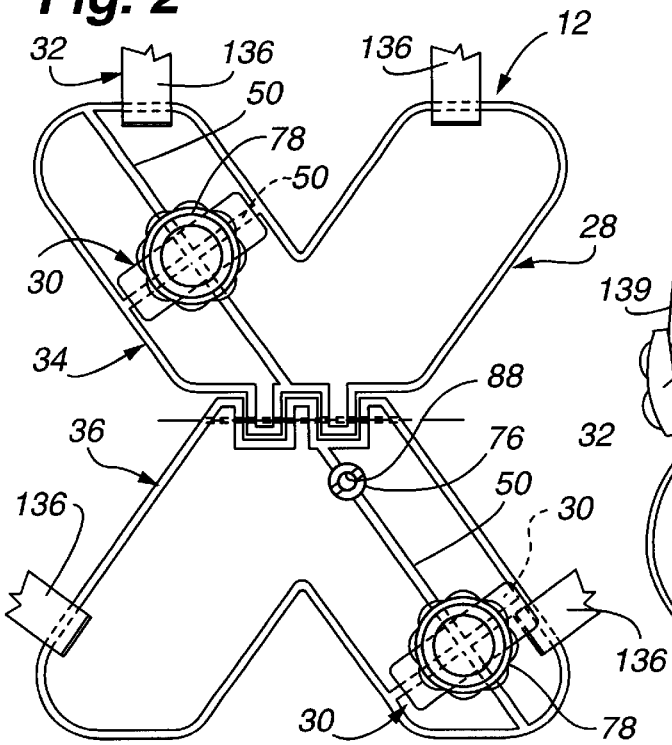
Fig. 3
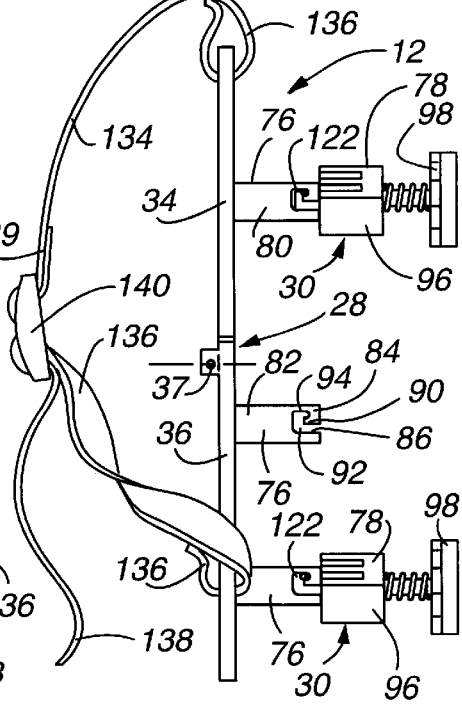

FOLDABLE SKI CARRIER PACK ASSEMBLY

PRIOR ART

A patent search was not conducted on this invention.

PREFERRED EMBODIMENT OF THE INVENTION

In one preferred embodiment of this invention, a foldable ski carrier pack assembly is utilized to be mounted on a shoulder area of a snow ski person similar to a camper's backpack assembly in order to receive and support snow skis thereon.

The foldable ski carrier pack assembly includes 1) a main ski support frame assembly; 2) ski anchor assemblies secured to the main ski support frame assembly to receive and support snow skis thereon; and 3) a back support harness assembly connected to the main ski support frame assembly and operable to be mounted about the shoulder area of the snow ski person similar to carrying the camper's backpack assembly.

The main ski support frame assembly includes 1) a first support frame member; 2) a second support frame member; and 3) a main connector member operable to pivotally connect the first support frame member to the second support frame member.

The first support frame member is of generally V-shape and includes a main support body having a first section integral with a second section. The first section includes transverse support ridges thereon on one side to add strength thereto.

About the first section and the second section are peripheral support ridges, outer top wall sections, and a male connector assembly, all positioned on the one side. The outer top wall sections are provided with strap support slots for connection to the back support harness assembly as will be noted.

The male connector assembly includes spaced connector arms, each having shaft support holes therein for connection to the main connector member as will be noted.

The second support frame member is of V-shape and a size similar to the first support frame member and having a main support frame member including 1) a support first section integral with a support second section; 2) a lower bottom wall section; and 3) a female connector assembly.

The support first section is provided with transverse support ridges on one side to add rigidity thereto. The support first section and the support second section are provided with an outer peripheral support ridge on the one side to add strength thereto.

The lower bottom wall section is provided with a side wall section having therein respective strap support slots for connection to the back support harness assembly as will be explained.

The female connector assembly is provided with connector slots and a central projection section having support shaft holes therein for connection to the main connector member.

The main connector member is provided with an anchor rod member to be mounted within an anchor housing and extended through the support shaft holes in the first support frame member and the second support frame member to allow relative pivotal movement therebetween in a manner to be explained.

The first support frame member and the second support frame assembly have smooth outer sides so as to be comfortable when placed against the back area of the snow ski person.

Each ski anchor assembly includes a stabilizing post member which is adapted to receive and support a retaining clamp assembly therein.

A plurality, namely three, stabilizing post members are illustrated with one being positioned within the first section of the first support frame member and secured at a juncture of the transverse support ridges to achieve maximum stability to the stabilizing post member.

Further, a pair of the stabilizing post members are mounted on the transverse support ridges in the support first section of the second support frame member and each of these stabilizing post members are operable to receive and support a respective one of the retaining clamp assemblies.

Each stabilizing post member includes a main post body member having a lower connector end section secured to or integral with a respective portion of the first support frame member and second support frame member and having integral therewith an outer clamp connector end section.

The outer clamp connector end section is provided with a clamp receiving slot assembly having a central hole, a diametric slot section, and a lock key hole section.

The lock key hole section is provided with a hook portion to lockingly receive respective ones of the retaining clamp assemblies therein as will be noted.

Each retaining clamp assembly includes a main clamp assembly having attached thereto an actuator handle assembly. Each main clamp assembly is of an irregular shape having a clamp body member with ski receiving spaced slots therein.

The ski receiving slots are defined by outer retaining walls and having a central support post. The central support post is provided with a central handle opening to receive a respective actuator handle assembly therethrough as will be noted.

The actuator handle assembly includes a handle assembly having 1) a knob member connected to an actuator shaft member; 2) a bias member mounted about the actuator shaft member; and 3) a lock pin member mounted at an outer end of the actuator shaft member.

The knob member is provided with a plurality of peripheral projections operable to be grasped and easily rotated by the snow ski person as will be explained.

The bias member is a compression spring member mounted about the actuator shaft member between the main clamp assembly and the knob member.

The lock pin member is mounted within a hole in an outer end of the actuator shaft member to keep the compression spring member biasing the knob member outwardly to a released retracted position.

The back support harness assembly includes a pair of harness strap assemblies, each having a first strap member and a second strap and buckle member.

The first strap member includes an anchor end mounted within a respective one of the strap support slots in the second support frame member. The first support strap is also provided with an actuator outer end section to be connected to the respective strap and buckle member.

Each second strap and buckle member is provided with a buckle member and having an anchor end which is secured within respective shaft support slots in the first support frame member.

Further, each second strap and buckle member is provided with a buckle connector section which is secured to a buckle member.

The actuator outer end section of the first strap member is operable to be connected to the buckle member on the second strap and buckle member in a conventional manner and to be adjustably mounted on the shoulder area of the snow ski person for ease of conveyance as noted in FIG. 1.

The respective ones of the retaining clamp assemblies are operable to be releasably mounted within the stabilizing post members as the actuator shaft member of the handle assembly and, more particularly, the lock pin is positioned through the central hole and diametrical slot section and into the lock hole key section of the outer clamp connector end section. The knob member and interconnected actuator shaft member are then rotated to place the lock pin in the hook portion of the lock key hole section as noted in FIG. 3. The knob member is then released and the compression spring holds the retaining clamp assembly in a locked, connected condition as shown in FIGS. 1–4.

OBJECTS OF THE INVENTION

One object of this invention is to provide a foldable ski carrier pack assembly which can be folded into a compact condition for easy of storage within a ski locker at a mountainside ski resort.

Another object of this invention is to provide a foldable ski carrier pack assembly which can be carried on a shoulder area of a snow ski person and having means thereon to lockably receive snow skis thereon for ease of conveyance thus leaving the snow ski person with hands free to carry other skiing gear, ski poles, and the like.

A further object of this invention is to provide a foldable ski carrier pack assembly which can be readily attached to a shoulder area of a snow ski person through a back support harness assembly and having ski anchor assemblies to receive and support snow skis thereon.

One other object of this invention is to provide a foldable ski carrier pack assembly which is readily foldable into a compact storage or ski locker condition; which is expandable and opened to be carried on a shoulder area of a snow ski person, like a backpack; and having mounted thereon ski anchor assemblies to receive and releasably support ski members thereon in an inclined manner.

Still, one other object of this invention is to provide a foldable ski carrier pack assembly which is low cost in construction; foldable to a compact condition for storage; readily attachable to a shoulder area of a snow ski person similar to a backpack; economical to manufacture; and substantially maintenance free.

Various other objects, advantages, and features of the invention will become apparent to those skilled in the art from the following discussion, taken in conjunction with the accompanying drawings, in which:

FIGURES OF THE INVENTION

FIG. 1 is a fragmentary back elevational view of a snow ski person having a foldable ski carrier pack assembly of this invention supporting snow skis and mounted on a skier's shoulder area;

FIG. 2 is a fragmentary rear elevational view of the foldable ski carrier pack assembly of this invention;

FIG. 3 is a side elevational view of the foldable ski carrier pack assembly of this invention;

Figure 4:
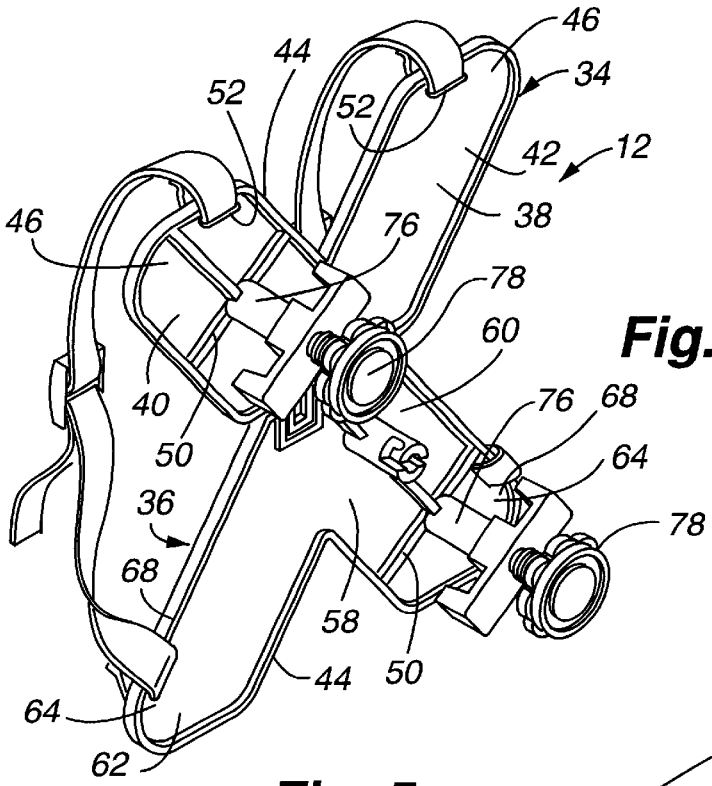
FIG. 4 is a perspective view of the foldable ski carrier pack assembly of this invention.

The following is a discussion and description of preferred specific embodiments of the foldable ski carrier pack assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

On referring to the drawings in detail, and in particular to FIG. 1, a snow ski person 16 is illustrated as utilizing a foldable ski carrier pack assembly 12 of this invention to carry a pair of snow skis 14.

The foldable ski carrier pack assembly 12 of this invention is connected similar to a camper's backpack assembly to a shoulder area 22 on the snow ski person 16 and having ski tips 18 of the snow skis 14 pointed in an inclined downward direction.

The snow skis 14 have typical ski bindings 20 which can be engageable with a portion of the foldable ski carrier pack assembly 12 to prevent longitudinal movement of the snow skis 14 when being used as shown in FIG. 1.

The foldable ski carrier pack assembly 12 includes 1) a main ski support frame assembly 28; 2) ski anchor assemblies 30 releasably connected to the main ski support frame assembly 28; and 3) a back support harness assembly 32 connected to the main ski support frame assembly 28 and operable to be mounted about and supported on the shoulder area 22 of the snow ski person 16 similar to a regular camping backpack assembly.

The main ski support frame assembly 28 includes 1) a first support frame member 34; 2) a second support frame member 36; and 3) a main connector member 37 operable to pivotally interconnect the first support frame member 34 to the second support frame member 36 in a manner to be explained.

Figure 5:
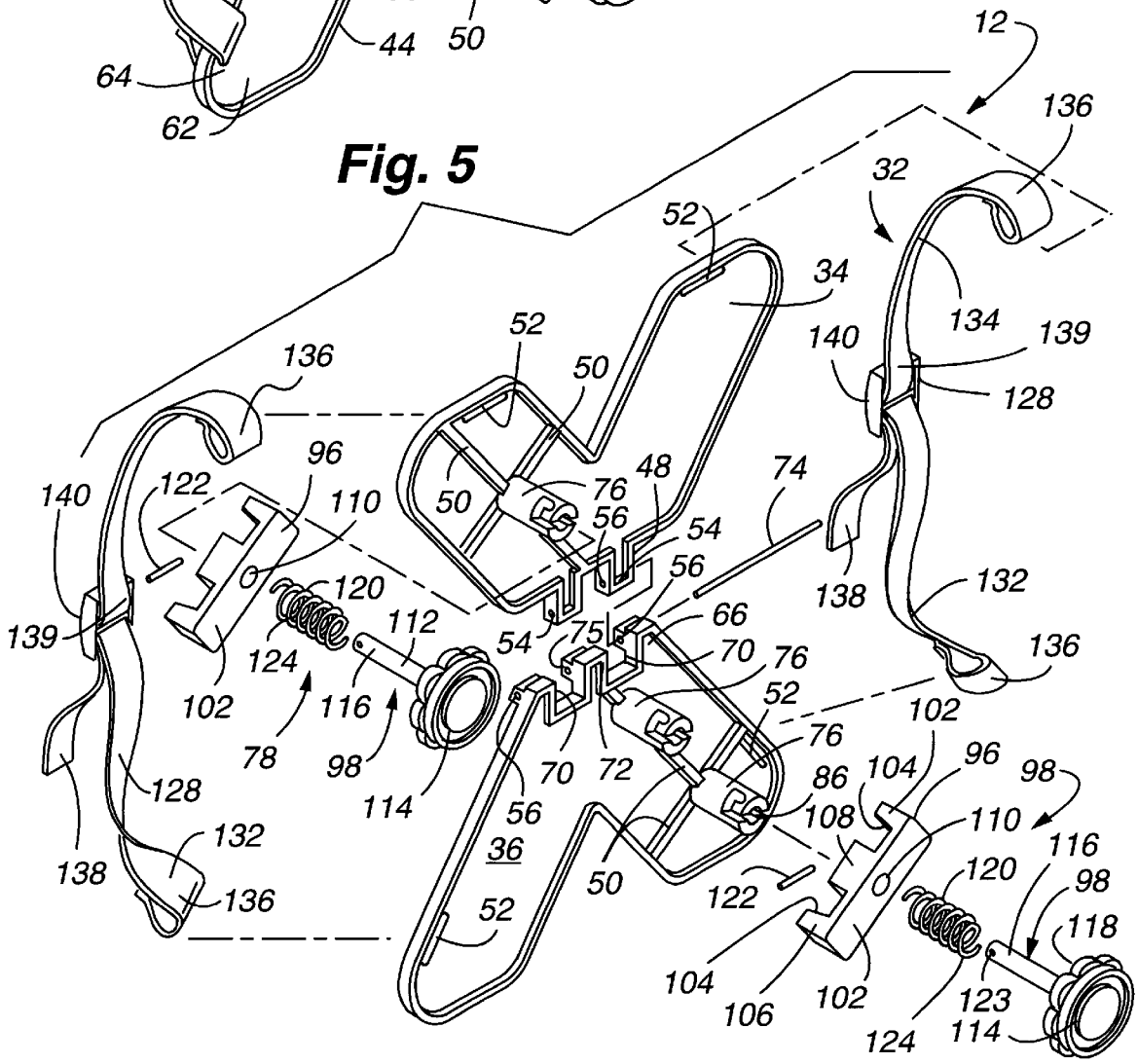
FIG. 5 is an exploded perspective view of the foldable ski carrier pack assembly of this invention.

As shown collectively in FIGS. 2, 3, 4, and 5, the first support frame member 34 is of generally V-shape having a main support body 38. The main support body 38 includes 1) a first section 40 integral with a second section 42; 2) a peripheral support ridge 44 mounted about the outer periphery of the first section 40 and the second section 42; 3) outer top wall sections 46; and 4) a male connector assembly 48 (FIG. 5).

The outer top wall sections 46 are each provided with a strap support slot 52 to receive a portion of the back support harness assembly 32 therein as will be explained.

The male connector assembly 48 includes a pair of spaced connector arms 54, each having an aligned shaft support hole 56 therein for reasons to be explained.

The second support frame member 36 is of a generally V-shape having a main support frame member 58 similar in size and shape as the main support body 38 of the first support frame member 34.

The main support frame member 58 includes a support first section 60 integral with a support second section 62 and having a bottom wall section 64 provided with a female connector assembly 66.

The support first section 60 is provided with transverse support ridges 50 on one side to add rigidity thereto and for supporting a portion of the ski anchor assemblies 30 as will be explained.

The support first section 60 and the support second section 62 are provided with a peripheral support ridge 44 on the one side.

The lower bottom wall sections 64 are provided with a side wall section 68, each having a support strap slot 52 (FIG. 5) for connection to the back support harness assembly 32 as will be explained.

As noted in FIG. 5, the female connector assembly 66 is provided with connector slots 70 and having a central projection section 72 having support shaft holes 56 therein.

The main connector member 37 includes an anchor rod member 74 insertable within support shaft holes 56 in an anchor housing 75 and through the support shaft holes 56 in the male connector assembly 48 of the first support frame member 34 so as to provide for relative pivotal movement therebetween.

The ski anchor assemblies 30 are each composed of a stabilizing post member 76 and a retaining clamp assembly 78. There are provided three stabilizing post members 76 and two retaining clamp assemblies 78 so that the snow skis 14 can be grasped at different positions depending on whether small children's snow skis 14 or a large person's snow skis 14 are being conveyed as there would be a considerable difference in overall size and length.

As noted in FIG. 3, each stabilizing post member 76 includes a main post body member 80 having a lower connector end section 82 and an outer clamp connector end section 84. Each respective lower connector end section 82 is secure or integral with a portion with the first section 40 of the first support frame member 34 or the support first section 60 of the second support frame member 36.

Each of the lower connector end sections 82 are integral with the respective transverse support ridges 50 so as to receive added rigidity and strength thereto.

As noted in FIG. 5, there are three of the spaced stabilizing post members 76 utilized therewith; normally only two are utilized at a time with a respective retaining clamp assembly 78.

As shown in FIG. 3, each outer clamp connector end section 84 is provided with an outer clamp receiving slot assembly 86 comprising a central hole 88; a diametrical slot section 90; and a lock key hole section 92.

The lock key hole section 92 is provided with a hook portion 94 to be engageable with a portion of the respective retaining clamp assembly 78 as will be explained.

Each retaining clamp assembly 78 includes a main clamp assembly 96 utilized with an actuator handle assembly 98. Each main clamp assembly 96 includes a clamp body member 102 having an adjacent pair of ski receiving slots 104 therein as noted in FIG. 5.

As shown in FIG. 5, the ski receiving slots 104 are defined by outer retaining walls 106 and a central support post 108. The central support post 108 is provided with a central handle opening 110 to receive a portion of the actuator handle assembly 98 therethrough as will be explained.

The ski receiving slots 104 are adapted to be placed over and about an outer peripheral edge of the snow skis 14 when in the conveyance condition as noted in FIG. 1.

On referring to FIG. 5, the actuator handle assembly 98 includes a handle assembly 112 having 1) a knob member 114 which is connected to an actuator shaft member 116; 2) a bias member 120 mounted about the actuator shaft member 116; and 3) a lock pin member 122 mounted within a pin hole 123 in an outer end of the actuator shaft member 116.

The knob member 114 is provided with outer peripheral projections 118 for ease of grasping and rotation thereof as will be explained.

The bias member 120 is a compression spring member 124 to bias the knob member 114 and an interconnected actuator shaft member 116 in an outer direction prior to connection to a stabilizing post member 76.

Figure 6:
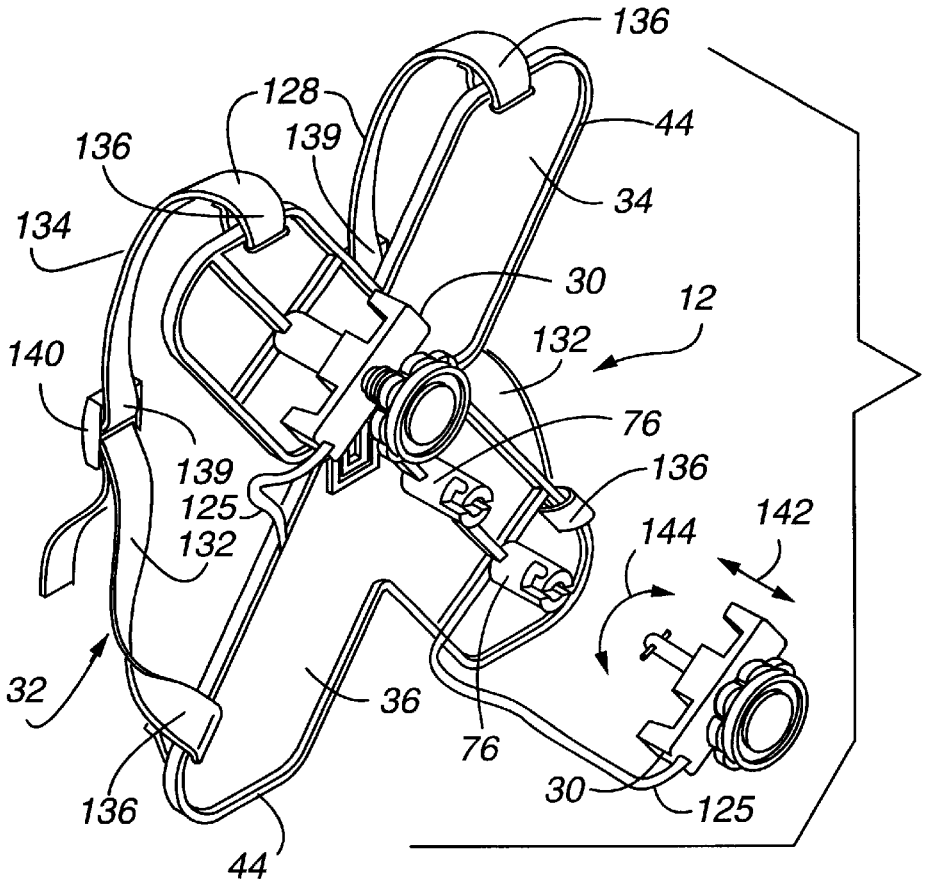
FIG. 6 is a perspective view similar to FIG. 4 illustrating movement and operation of a ski anchor assembly of this invention.

As noted in FIG. 6, each retaining clamp assembly 78 can be connected to adjacent portions of the main ski support frame assembly 28 by a high strength plastic or metal retainer strap 125.

The back support harness assembly 32, as best noted in FIG. 5, includes a pair of harness strap assemblies 128, each operable to be placed about a respective right and left shoulder area 22 of the snow ski person 16 when mounted thereon and conveyed as shown in FIG. 1.

Each harness strap assembly 128 includes a first strap member 132 releasably connectable to a second strap and buckle member 134. The first strap member 132 and the second strap and buckle member 134 each have outer anchor ends 136 which are connected to respective ones of the strap support slots 52 in the outer top wall sections 64.

The first strap members 132 each have an actuator outer end section 138 to be releasably connected to a respective one of the second strap and buckle members 134.

Each second strap and buckle member 134 includes a buckle member 140 connected to a respective buckle connector section 139.

The buckle member 140 is of a conventional nature operable to slidably receive and anchor the respective actuator outer end sections 138 of the first strap member 132 when conveyed by the snow ski person 16 noted in FIG. 1 and as shown in FIGS. 3, 4, and 5.

Use and Operation of the Invention

Figure 7:
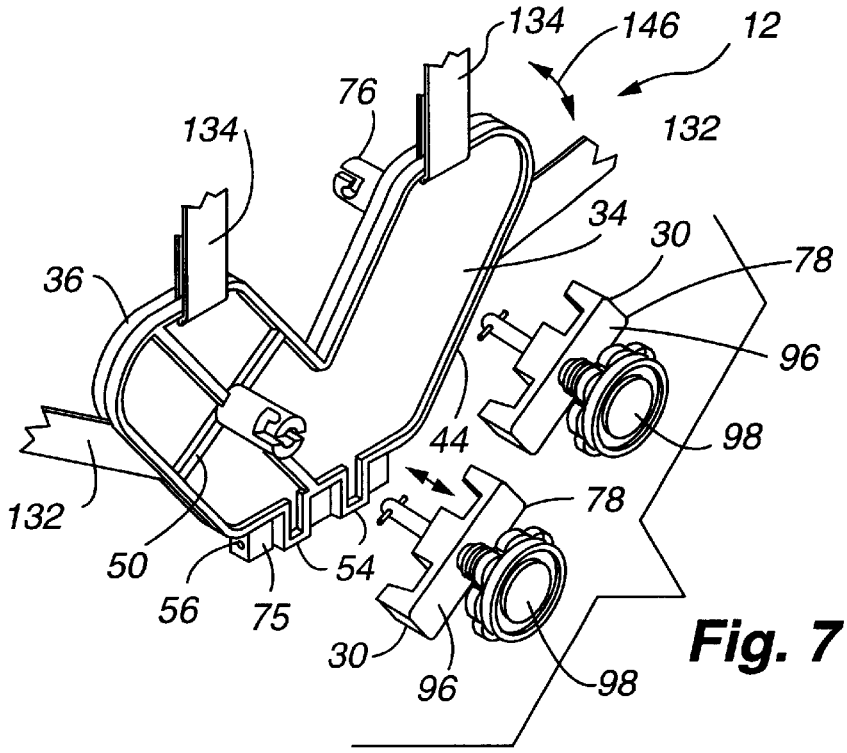
FIG. 7 is a fragmentary perspective view of the foldable ski carrier pack assembly in a collapsed, folded condition with two ski anchor assemblies separated therefrom.

In the use and operation of the foldable ski carrier pack assembly 12 of this invention, please refer to FIG. 7 which shows the invention in a folded compact condition for storage or temporary placement in a ski locker at a ski resort area. It is noted that the first support frame member 34 and the second support frame member 36 are folded about the main connector member 37 by use of the male connector assembly 48 and the anchor housing 75, both pivotal about the anchor rod member 74, to be placed in the compact folded condition.

Also, as noted in FIG. 7, the ski anchor assemblies 30 have been disconnected from respective stabilizing post members 76 leaving the retaining clamp assemblies 78 spaced therefrom but secured, to keep from being lost, by the respective retainer straps 125 (FIG. 6). These can be placed against an outer surface of, for example, the first support frame member 34 and the back support harness assembly 32 wrapped thereabout to decrease the size and space for ease of retaining in the ski locker at the ski resort area.

As noted in FIG. 7, the actuator handle assembly 98 is illustrated in a forced inwardly position against the force of the compression spring member 124. Normally the knob member 114 would be in a fully extended position due to the action of the compression spring member 124 against the knob member 114.

In the use of the foldable ski carrier pack assembly 12, it is noted that the main ski support frame assembly 28 in the fully extended condition, as noted in FIGS. 2, 3, and 4, may be laid on a support ground surface and the respective ski anchor assemblies 30 removed from the respective stabilizing post member 76.

Next, the snow ski person 16 would place the snow skis 14 thereagainst and then re-secure the respective ski anchor assemblies 30 thereto. This is accomplished by placing the respective main clamp assembly 96 and the clamp body member 102 against the outer edges of the snow skis 14 in a proper axial alignment with the respective stabilizing post member 76. The ski receiving slots 104 are placed about outer respective side walls of the snow skis 14.

Next, the knob member 114 is depressed which moves the actuator shaft member 116 towards the snow skis 14 and actually inserts the actuator shaft member 116 within the central handle opening 110 in the respective central hole 88 in the clamp receiving slot assembly 86.

The snow ski person 16 would continue to move the knob member 114 and interconnected actuator shaft member 116 inwardly until the lock pin member 122 reaches the bottom of the central hole 88. The knob member 114 is then rotated to place the lock pin member 122 within the hook portion 94 of the lock key hole section 92 of the clamp receiving slot assembly 86 (FIG. 3).

Next, the snow ski person 16 releases pressure against the knob member 114 and interconnected actuator shaft member 116 whereupon the compression spring member 124 is operable to move the lock pin member 122 into the hook portion 94 and to hold therein in a spring biased locked condition as noted in FIG. 3.

This procedure is completed until two of the retaining clamp assemblies 78 are interconnected to respective stabilizing post members 76 as noted in FIGS. 3 and 4. It is obvious that this would securely clamp the snow skis 14 of the snow ski person 16 therein and hold in a rigid manner for ease of conveyance as shown in FIG. 1.

It is obvious that on reaching a snow skiing area or storage locker in a snow ski lodge, the snow ski person 16 would release the harness strap assembly 128 whereupon the snow skis 14 can be readily removed from the grasp of the ski anchor assemblies 30 for placement in a ski rack and subsequent use in a snow skiing function.

Then, the foldable ski carrier pack assembly 12 can be folded into a compact condition as previously discussed and shown in FIG. 7 for placement in a ski locker while proceeding with a snow skiing operation.

The reverse procedure would be accomplished by one retiring from a particular snow skiing operation and the foldable ski carrier pack assembly 12 is opened and interconnected to the snow skis 14 as noted in FIG. 1 for conveyance back to the ski lodge or to a transportation vehicle of the snow ski person 16.

When the foldable ski carrier pack assembly 12 is in an extended usage condition with the first support frame member 34 in a common plane with the second support frame member 36, the male connector assembly 48 abuts the female connector assembly 66 and limits pivotal movement of the first support frame member 34 relative to the second support frame member 36 to 180 degrees from the abutting storage condition to the extended usage condition.

The foldable ski carrier pack assembly is economical to manufacture; easy and fast to move from a storage to a usage condition; compact and lightweight; sturdy in construction; and substantially maintenance free.

While the invention has been described in conjunction with preferred specific embodiments thereof, it will be understood that this description is intended to illustrate and not to limit the scope of the invention, which is defined by the following claims

I claim:

1. A foldable ski carrier pack assembly adapted to receive and convey snow skis, comprising:

a) a main ski support frame assembly;

b) a ski anchor assembly connected to said main ski support frame and operable to secure a pair of snow skis thereagainst;

c) a back support harness assembly connected to said main ski support frame assembly and adapted to be connected to a person for ease of conveyance of the snow skis;

d) said main ski support frame assembly includes a first support frame member pivotally connected to a second support frame member;

e) said ski anchor assembly includes a stabilizing post member secured to said main ski support frame assembly and a retaining clamp assembly releasably connected to said stabilizing post member;

f) said retaining clamp assembly includes a main clamp assembly connected to an actuator handle assembly;

g) said main clamp assembly includes a clamp body member operable to be engageable with the snow skis in a clamping manner; and h) said actuator handle assembly includes a knob member connected to an actuator shaft member, said actuator shaft member engageable with said stabilizing post member and placed in a biased locked condition to hold said retaining clamp assembly against said stabilizing post member and holding the snow skis against said main ski support frame assembly;

whereby said first support frame member can be pivoted 180 degrees to contact said second support frame member into a compact condition for storage in a ski locker.

2. A foldable ski carrier pack assembly as described in claim 1, wherein:

a) said actuator handle assembly includes a bias member engageable with said main clamp assembly and said knob member to provide a biasing force to move the actuator shaft member in a retracted condition; and b) said actuator shaft member movable axially against said bias member so as to be engageable with said stabilizing post member and being rotatable to lock into engagement with and secured to said stabilizing post member.

3. A foldable ski carrier pack assembly as described in claim 1, wherein:

a) one of said ski anchor assemblies is connected to each of said first support frame member and said second support frame member;

b) said ski anchor assembly includes a stabilizing post member secured to respective ones of said first support frame member and said second support frame member and having a retaining clamp assembly engageable with respective ones of said stabilizing post members;

c) said stabilizing post member having an outer clamp connector end section having a clamp receiving slot assembly therein;

d) said retaining clamp assembly includes a clamp body member connected to an actuator handle assembly;

e) said actuator handle assembly includes a knob member connected to an actuator shaft member having a lock pin on an outer end thereof; and f) said actuator shaft member with said lock pin member is to be placed with said clamp receiving slot assembly in a manner to be released therefrom in a non-clamping condition and engageable therewith in a locked, clamped condition.

4. A ski carrier pack assembly, comprising:

a) a main ski support frame assembly;

b) a ski anchor assembly having a post member secured to said main ski support frame assembly and an actuator handle assembly connected to said post member;

c) said actuator handle assembly adapted to be engageable with snow skis to hold against said main ski support frame assembly for ease of conveyance; and d) conveyance means connected to said main ski support frame assembly and adapted to be connected to a person for ease of conveyance.

5. A foldable ski carrier pack assembly as described in claim 4, wherein:

a) said main ski support frame assembly includes a first support frame member pivotally connected by a main connector member to a second support frame member;

b) said first support frame member is pivoted into abutting engagement with said second support frame member when in a compact storage condition requiring a minimum amount of storage space; and c) said first support frame member is pivotal outwardly from said second support frame member and both lying in a common plane when in a fully extended usage condition.

6. A foldable ski carrier pack assembly as described in claim 5, wherein:

a) said actuator handle assembly includes a knob member connected to an actuator shaft member having a lock pin member; a clamp body member connected to said actuator shaft member; and a bias member mounted between said clamp body member and said knob member;

b) said bias member forces said knob member to a retracted position; and c) said lock pin member engagable with said post member to hold said clamp body member against the snow skis in a biased condition.

7. A foldable ski carrier pack assembly as described in claim 4, wherein:

a) said main ski support frame assembly has a first support frame member pivotally connected to a second support frame member; both being of a generally V-shape; and b) said first support frame member pivotal outwardly to lie in a common plane with said second support frame member and said main ski support frame assembly, being of an X-shape in the extended usage condition.

8. A foldable ski carrier pack assembly as described in claim 7, wherein:

a) said first support frame assembly abuts said second support frame assembly in the extended usage condition to limit pivotal movement to a maximum of 180 degrees.

9. A foldable ski carrier pack assembly as described in claim 6, wherein:

a) said post member includes an outer clamp connector end section;

b) said clamp connector end section includes a clamp receiving slot assembly having a central opening and a lock key hole section; and c) said actuator shaft member inserted into said central opening and rotated to engage said lock pin member with said lock key hole section.

10. A foldable ski carrier pack assembly as described in claim 9, wherein:

a) said clamp receiving slot assembly having a diametrical slot section extended across said central opening allowing said lock pin member to extend transversely of said central opening; and b) said lock key hole section having a hook portion to receive said lock pin member therein when in a locked condition with said post member.

11. A carrier assembly adapted to carry an object, comprising:

a) a main support frame assembly having a first support frame member pivotally connected to a second support frame member;

b) said first support frame member abuts said second support frame member when in a compact storage condition requiring a minimum amount of space;

c) said first support frame member and said second support frame member in a common plane when in an extended usage condition;

d) conveyance means connected to said main ski support frame assembly and adapted to be connected to a person for ease of conveyance; and e) an anchor assembly connected to said first support frame member and said second support frame member to hold the object thereagainst in the extended usage condition;

f) said anchor assembly includes a support post member retaining clamp assembly releasably connected to said support post member;

g) said retaining clamp assembly includes a clamp body member having an actuator handle assembly connected to said clamp body member;

h) said clamp body member engageable with the object to hold against said main support frame assembly; and i) said actuator handle assembly connected to said support post member in a usage condition;

whereby said first support frame member can be pivoted 180 degrees to contact said second support frame member into a compact condition for storage in a ski locker.

* * * * *